US008044909B2

(12) United States Patent
Sakashita et al.

(10) Patent No.: US 8,044,909 B2
(45) Date of Patent: Oct. 25, 2011

(54) LIQUID-CRYSTAL DISPLAY APPARATUS, CONTROL METHOD THEREOF, AND COMPUTER PROGRAM

(75) Inventors: Yukihiko Sakashita, Kawasaki (JP); Akihiro Ouchi, Tokyo (JP); Ryosuke Mizuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 936 days.

(21) Appl. No.: 11/947,171

(22) Filed: Nov. 29, 2007

(65) Prior Publication Data

US 2008/0252583 A1 Oct. 16, 2008

(30) Foreign Application Priority Data

Dec. 1, 2006 (JP) ..... 2006-325925

(51) Int. Cl.
*G09G 3/36* (2006.01)

(52) U.S. Cl. ..... 345/96; 345/102; 345/204

(58) Field of Classification Search ..... 345/89, 345/96, 102, 204
See application file for complete search history.

(56) References Cited

U.S. PATENT DOCUMENTS

| | | | | |
|---|---|---|---|---|
| 6,310,628 | B1 | 10/2001 | Matsushita et al. | 345/684 |
| 6,320,575 | B1 | 11/2001 | Terashima et al. | 345/213 |
| 6,501,451 | B1 | 12/2002 | Sakashita | 345/87 |
| 6,661,400 | B2 | 12/2003 | Sakashita | 345/89 |
| 7,023,413 | B1 | 4/2006 | Terashima et al. | 345/98 |
| 7,474,361 | B2 * | 1/2009 | Sakashita | 348/745 |
| 2004/0196274 | A1 * | 10/2004 | Song et al. | 345/204 |
| 2005/0001825 | A1 * | 1/2005 | Huang | 345/204 |
| 2005/0104835 | A1 * | 5/2005 | Misonou et al. | 345/96 |
| 2005/0219269 | A1 * | 10/2005 | Sakashita | 345/685 |
| 2006/0150222 | A1 * | 7/2006 | McCafferty et al. | 725/81 |
| 2006/0221069 | A1 * | 10/2006 | Sakashita | 345/204 |
| 2008/0055229 | A1 * | 3/2008 | Shen et al. | 345/102 |
| 2008/0094332 | A1 * | 4/2008 | Tseng | 345/89 |

FOREIGN PATENT DOCUMENTS

| | | |
|---|---|---|
| JP | 11-126050 | 5/1999 |
| JP | 2001-034238 | 2/2001 |

* cited by examiner

*Primary Examiner* — Amare Mengistu
*Assistant Examiner* — Premal Patel
(74) *Attorney, Agent, or Firm* — Fitzpatrick, Cella, Harper & Scinto

(57) ABSTRACT

A liquid-crystal display apparatus comprising, a liquid-crystal display device driven by an AC voltage, an image divider configured to temporally divide input image data into N (N≧2) for each frame, a correction unit configured to correct a driving voltage for driving the liquid-crystal display device based on a difference between adjacent divided image data obtained by the N division, a polarity inverter configured to invert a polarity to make drive polarities of adjacent divided image data different, out of the divided image data obtained by the N division including the divided image data for which driving voltage is corrected by the correction unit, a driver configured to drive the liquid-crystal display device using the polarity-inverted divided image data, and an inversion order alteration unit which alters an inversion order for the drive polarities.

5 Claims, 13 Drawing Sheets

LIQUID-CRYSTAL DISPLAY APPARATUS, CONTROL METHOD THEREOF, AND COMPUTER PROGRAM

BACKGROUND OF THE INVENTION

1. Field of the Invention

The present invention relates to a liquid-crystal display apparatus, control method thereof, and computer program.

2. Description of the Related Art

Recently, liquid-crystal display apparatuses have been used as a TV receiver and the display device of a PC. Liquid-crystal display apparatuses can have flat panels, achieve space saving and power reduction, and thus are widely used. However, liquid-crystal display apparatuses suffer a long response time until image data is actually displayed. As a liquid-crystal display apparatus driving method for increasing the response speed, there is proposed a method of comparing image data to be displayed next with previous image data, and performing overdrive in accordance with the comparison result (see Japanese Patent Laid-Open No. 11-126050).

When overdrive is performed on only one side (positive or negative side) of AC driving, a DC component remains, as shown in FIG. 13. The reliability may degrade depending on the structure and arrangement of the liquid-crystal display apparatus. To prevent this, there is also proposed the following method for a liquid-crystal display apparatus in which a pixel electrode and opposite electrode are formed on the same substrate and a voltage is generated parallel to the substrate. More specifically, at least either the pixel electrode or opposite electrode is formed from an ITO film to suppress degradation of the reliability caused by the DC component (see Japanese Patent Laid-Open No. 2001-34238).

This liquid-crystal display apparatus adopts the structure in which at least either the pixel electrode or opposite electrode is formed from an ITO film. This structure can suppress degradation of the reliability caused by a DC component left after overdrive. However, this structure cannot be widely applied to a variety of liquid-crystal display apparatuses because the panel structure of the liquid-crystal display apparatus must be changed.

As described above, a conventional display apparatus cannot increase the response speed and reliability by removing an unbalanced DC component generated by overdrive without changing the panel structure.

SUMMARY OF THE INVENTION

It is an object of the present invention to provide an invention capable of removing an unbalanced DC component generated by overdrive and increasing the response speed and reliability without changing the panel structure.

An invention corresponding to one aspect of the present invention relates to a liquid-crystal display apparatus comprising a liquid-crystal display device driven by an AC voltage, an image divider configured to temporally divide input image data into N ($N \geqq 2$) for each frame, a correction unit configured to correct a driving voltage for driving the liquid-crystal display device based on a difference between adjacent divided image data obtained by the N division, a polarity inverter configured to invert a polarity to make drive polarities of adjacent divided image data different, out of the divided image data obtained by the N division including the divided image data for which driving voltage is corrected by correction unit, a driver configured to drive the liquid-crystal display device using the polarity-inverted divided image data, and an inversion order alteration unit which alters an inversion order for the drive polarities.

Further features of the present invention will become apparent from the following description of exemplary embodiments (with reference to the attached drawings).

DESCRIPTION OF THE EMBODIMENTS

Preferred embodiments of the present invention will be described in detail below with reference to the accompanying drawings. The following embodiments do not limit the claims of the present invention, and not all combinations of features set forth in the embodiments are essential in solving means of the present invention.

First Embodiment

Figure 1:
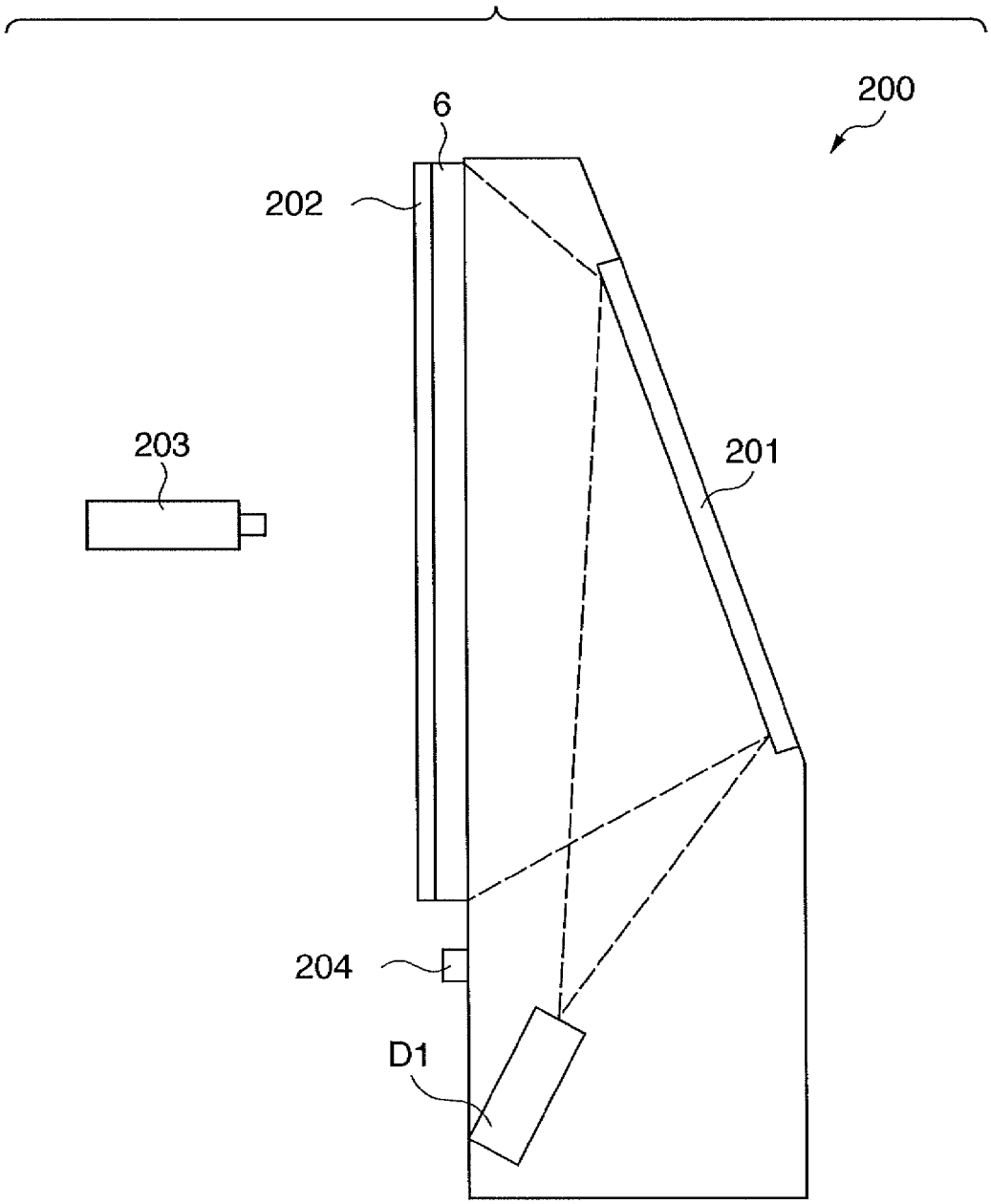
FIG. 1 is a side view showing an example of a rear projection display apparatus 200 according to the first embodiment of the present invention.

FIG. 1 is a side view showing an example of a rear projection display apparatus 200 according to the first embodiment of the present invention.

In FIG. 1, an image projected from a projection display engine D1 is reflected by a reflecting mirror 201, and projected from the rear surface of a screen 6. A digitizer 202 is attached to the front surface of the screen 6. The user can indicate a position with a digitizer pen 203 on the front surface of the screen 6 equipped with the digitizer 202, and input the coordinates of the indicated position to the display apparatus 200. As the digitizer, various types are available including an optical type, pressure sensitive type, and ultrasonic type. A brightness adjustment switch 204 is used to adjust the brightness of an image displayed on the screen 6.

The structure of the projection display engine D1 according to the first embodiment of the present invention will be explained with reference to FIG. 2.

Figure 2:
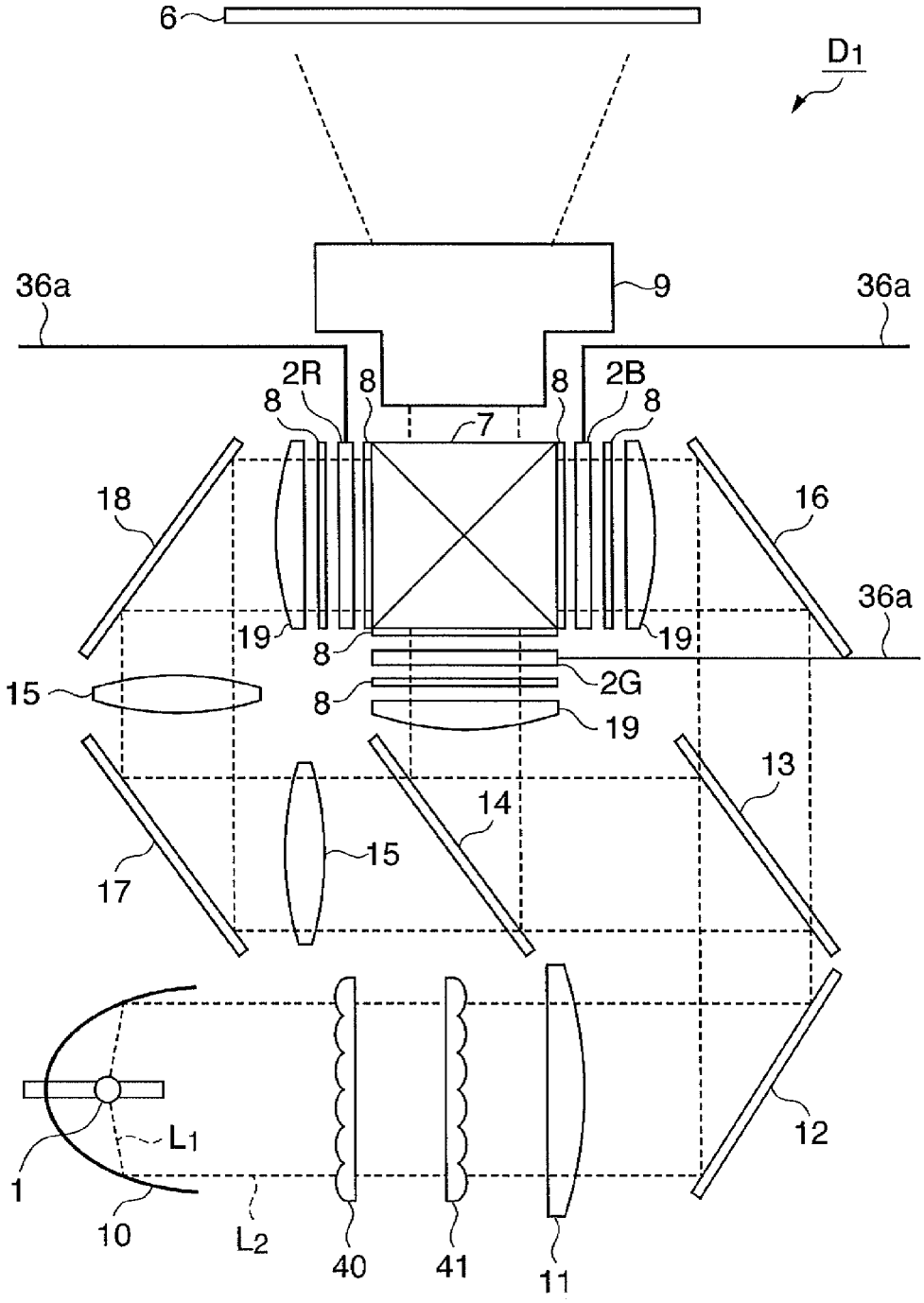
FIG. 2 is a sectional view showing a structure of a projection display engine D1 according to the first embodiment of the present invention.

In FIG. 2, three liquid-crystal panels 2R, 2G, and 2B corresponding to R, G, and B display colors are used as light modulation devices, and arranged to face a crossed prism 7. In the first embodiment, the liquid-crystal panels 2R, 2G, and 2B are TN liquid-crystal panels driven using TFTs. Polarizing plates 8 are arranged on the two sides of each of liquid-crystal panels 2R, 2G, and 2B so as to sandwich it. A projection lens 9 and the screen (projected member) 6 are arranged on the light exit side of the crossed prism 7.

A parabolic reflector 10 surrounds a lamp (light source) 1, and converts light L1 emitted from the lamp 1 into a parallel beam L2. The reflector 10 may be not parabolic but elliptic, and may convert the light L1 into a convergent beam. As the lamp 1, a metal halide lamp, xenon lamp, or the like is available. Fly-eye integrators 40 and 41 are arranged on the optical path of light emitted from the lamp 1 so as to be conjugate to the liquid-crystal panels 2R, 2G, and 2B. The fly-eye integrators 40 and 41 improve the non-uniformity of the light source. A relay lens 11 and mirror 12 are arranged in the order named on the light exit side of the fly-eye integrators 40 and 41. At the subsequent stage, two dichroic mirrors 13 and 14 are arranged to split light emitted from the lamp 1 into three beams. Relay lenses 15 and mirrors 16, 17, and 18 are arranged to guide these beams to the liquid-crystal panels 2R, 2G, and 2B. Reference numeral 19 denotes a field lens.

Figure 3:
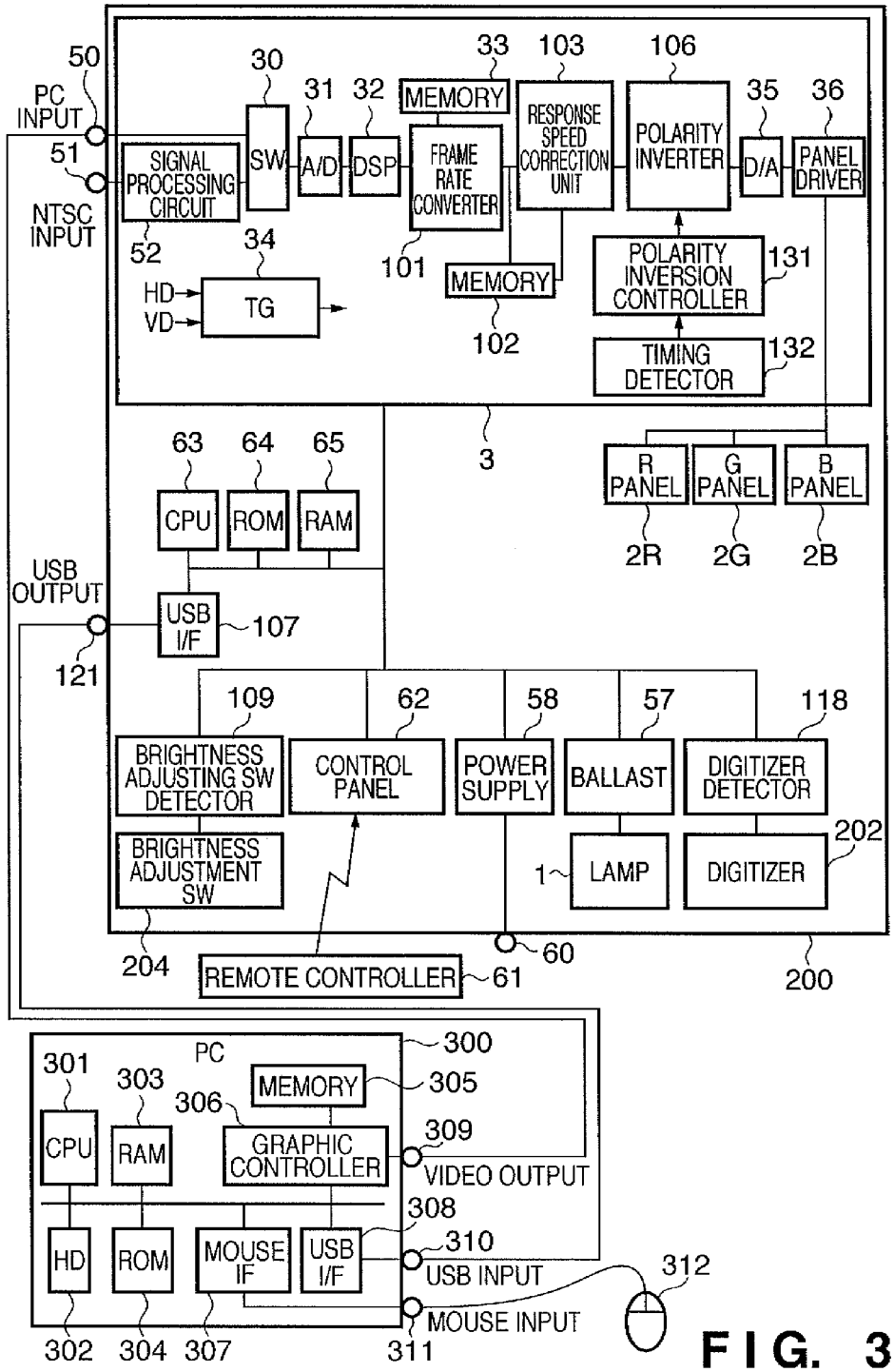
FIG. 3 is a block diagram showing the arrangement of the display engine of the display apparatus according to the first embodiment of the present invention.

The liquid-crystal panels 2R, 2G, and 2B are connected to a video signal input unit 3 and the like as shown in FIG. 3.

Processing of an electrical signal by the projection display engine D1 according to the first embodiment will be described. FIG. 3 is a block diagram showing an arrangement of the display engine of the display apparatus 200 according to the first embodiment of the present invention.

In the video signal processing unit 3, a switch 30 switches between a video signal input from a PC via a terminal 50 and an NTSC signal input from a terminal 51. NTSC signals include the video signals of general TV broadcast programs. NTSC signals also include video signals obtained from recording apparatuses (e.g., videotape recorder, DVD recorder, and HDD recorder) which record video signals on a medium, and playback apparatuses (e.g., DVD player and LD player) which play back video signals recorded on a medium. A signal processing circuit 52 performs signal processes such as decoding of an NTSC signal, noise reduction, bandpass filtering, and signal level adjustment for an NTSC signal input from the terminal 51. An A/D converter 31 converts an input analog video signal into a digital signal.

A DSP (Digital Signal Processor) 32 receives A/D-converted digital image data, executes predetermined signal processing, and outputs the execution result to a frame rate converter 101. The predetermined signal processing includes image processes such as contrast/brightness adjustment, color conversion, and resolution conversion. The frame rate converter 101 converts the frame rate of input image data. A memory 33 holds the current image data, image data to be displayed by the next frame, and the like.

A timing generator (TG) 34 outputs a timing signal which defines the operation timing of each unit. A memory 102 stores previous image data in order to correct the response speed. A response speed correction unit 103 compares image data output from the frame rate converter 101 with image data via the memory 102, and corrects the response speed by correcting the driving voltage. A polarity inverter 106 inverts the polarity of an image signal on the basis of input image data.

A polarity inversion controller 131 instructs the polarity inverter 106 to alter the polarity inversion order. A timing detector 132 detects the timing to alter the polarity inversion order. A D/A converter 35 converts digital image data into an analog image signal, and outputs the analog image signal to a panel driver 36. By the analog image signal, video signals and power are supplied to the R, G, and B liquid-crystal panels 2R, 2G, and 2B via the panel driver 36.

FIG. 3 shows only an analog input signal, but the present invention is not limited to this. For example, it is also effective to arrange an input terminal for a digital signal such as LVDS or TMDS, or a D4 terminal for a digital TV.

A ballast 57 is a lamp power supply connected to the lamp 1. A power supply 58 functions as a power supply means for supplying the operating power of the display apparatus 200. Reference numeral 60 denotes an AC inlet. A remote controller 61 designates various operations of the display apparatus 200. A control panel 62 receives a signal from the remote controller 61.

Reference numeral 204 denotes a brightness adjustment switch. A brightness adjusting switch detector 109 detects the operation of the brightness adjusting switch 204. A digitizer detector 118 detects coordinates indicated by the digitizer 202. Reference numeral 107 denotes a USB interface (I/F); 63, a CPU; 64, a ROM; and 65, a RAM. The CPU 63 is connected to the video signal input unit 3, control panel 62, ballast 57, brightness adjusting switch detector 109, digitizer detector 118, USB I/F 107, and the like. The CPU 63 performs driving control of the liquid-crystal panels 2R, 2G and 2B, the lamp 1, and the like, and enlarges/reduces/moves a display image.

The brightness adjusting switch detector 109, digitizer detector 118, USB I/F 107, and the like are connected to the CPU 63 in the first embodiment, but may also be incorporated in the CPU or executed in accordance with programs.

The arrangement of a PC (Personal Computer) 300 connected to the display apparatus 200 will be explained. The PC 300 comprises a CPU 301, HD (Hard disk) 302, RAM 303, ROM 304, video memory 305, graphic controller 306, mouse I/F 307, and USB I/F 308. The PC 300 further comprises a video output terminal 309, USB input terminal 310, and mouse input terminal 311. A mouse 312 functions as a pointing device, and is connected to the mouse input terminal 311.

The operation of the display apparatus 200 according to the first embodiment will be explained in detail with reference to FIGS. 3 to 8.

In the display apparatus 200, the switch 30 selects either a video signal input from the PC input terminal 50 or a video signal input from the NTSC input terminal 51. The A/D converter 31 converts the selected video signal from an analog signal into a digital signal. The DSP 32 performs image processes such as contrast/brightness adjustment and color conversion for the digital image data. The frame rate converter 101 converts the image data output from the DSP 32 into data with a desired resolution and frame rate.

The frame rate converter 101 temporally divides one frame into N by image division. N is an arbitrary integer of 2 or more, and the frame rate is multiplied by N in accordance with the division count. In the first embodiment, as an example of N division, N=2, i.e., a video input signal at a vertical frequency of 60 Hz is converted into a signal with a frame rate at a double vertical frequency of 120 Hz. At this time, image data of at least one input frame is stored in the memory 33. An input image signal can be converted into a divided image signal having a different frame rate by changing the readout speed of image data from the memory 33.

FIGS. 4 to 8 show signals for driving a specific pixel of the liquid-crystal panel by respective signal processors of the display apparatus according to the first embodiment.

Figure 4:
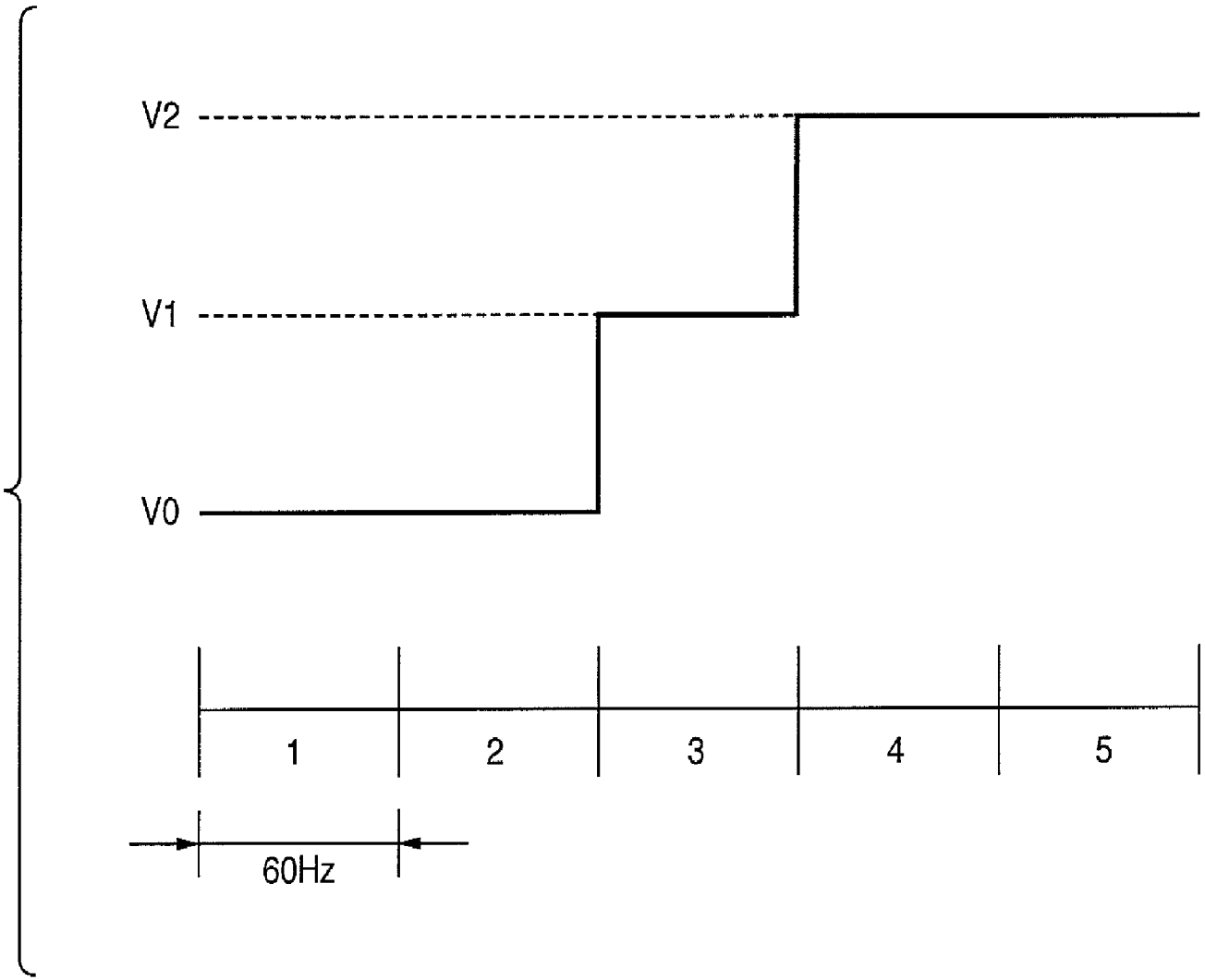
FIG. 4 is a chart showing an example of a signal input to a frame rate converter 101 to drive a specific pixel of a liquid-crystal panel according to the first embodiment of the present invention.

FIG. 4 is a chart showing a signal input to the frame rate converter 101 to drive a specific pixel of the liquid-crystal panel. In FIG. 4, the signal corresponds to a 60-Hz video input signal of five frames. A black signal is input (voltage V0) in frames 1 and 2, and changes to halftone image data 1 (voltage V1) in frame 3. In frame 4, halftone image data 1 changes to brighter halftone image data 2 (voltage V2).

Figure 5:
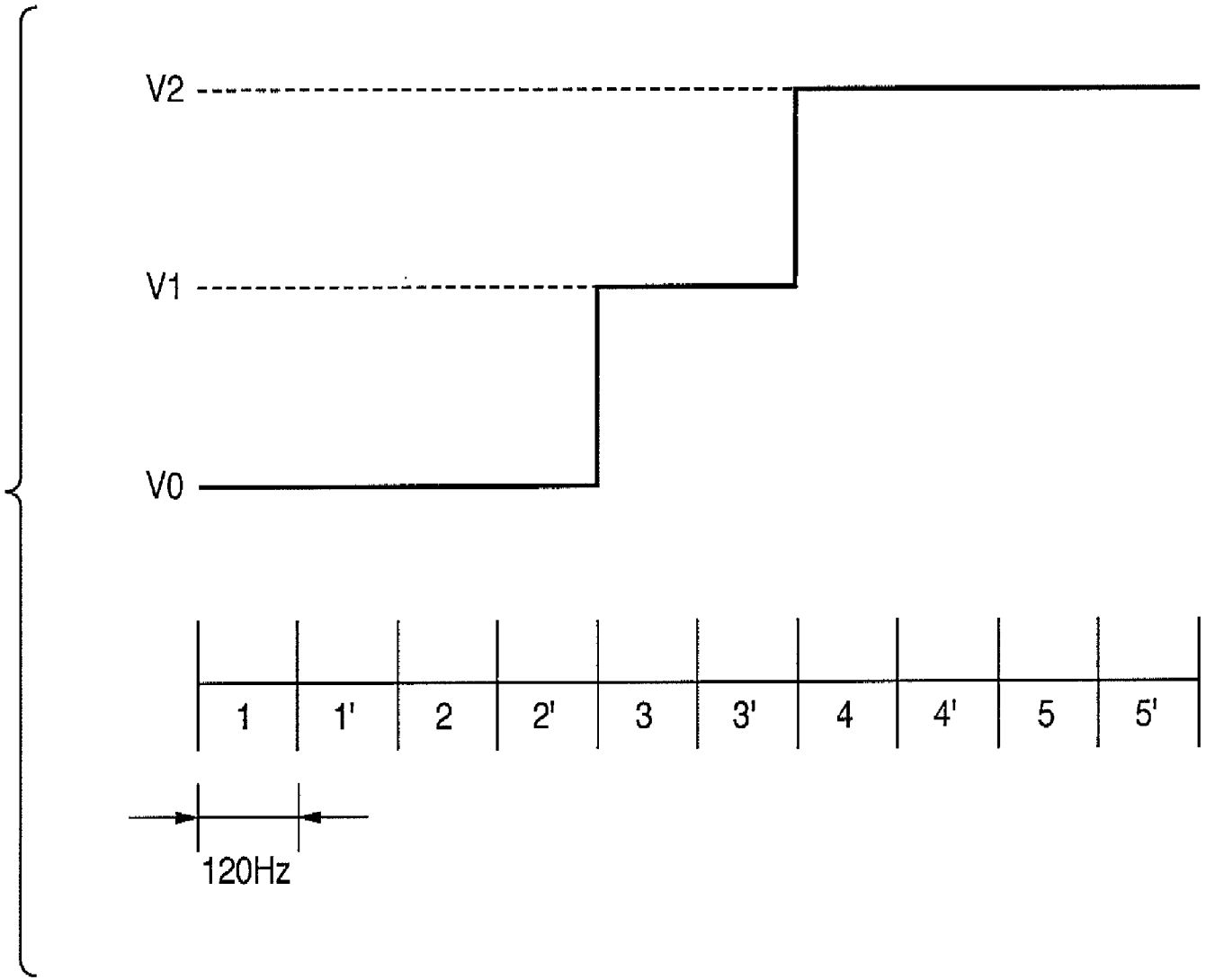
FIG. 5 is a chart showing an example of image data output from the frame rate converter 101 according to the first embodiment of the present invention.

FIG. 5 is a chart showing image data output from the frame rate converter 101. In FIG. 5, each frame shown in FIG. 4 is temporally divided into two frames such that frame 1 is divided into frames 1 and 1' and frame 2 is divided into frames 2 and 2'.

In the first embodiment, the frame rate converter 101 converts the frame rate of an image from 60 Hz into 120 Hz. The frame rate converter 101 doubles the frame rate by reading out image data successively twice from the memory 33. To increase the response speed of the display apparatus 200, the response speed correction unit 103 corrects the driving voltage and executes so-called overdrive.

Figure 6:
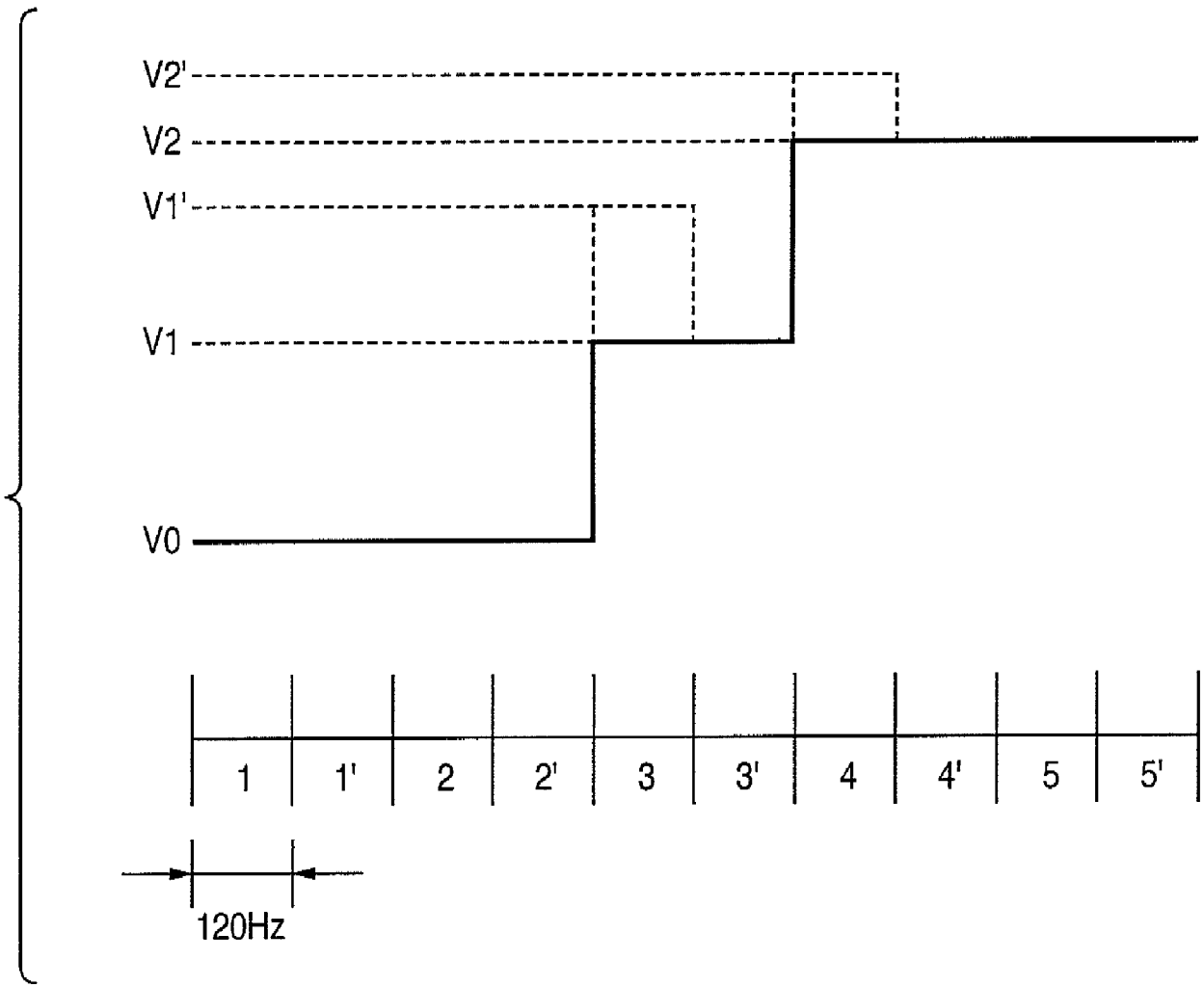
FIG. 6 is a chart showing an example of image data output from a response speed correction unit 103 according to the first embodiment of the present invention.

FIG. 6 is a chart showing image data output from the response speed correction unit 103 according to the first embodiment.

The response speed correction unit 103 compares image data of an immediately preceding frame stored in the memory 102 with the current image data. If the image data has changed, the response speed correction unit 103 performs overdrive in accordance with the comparison result. In the example of FIG. 5, frame 3 is different from immediately preceding frame 2'. Thus, the voltage V1 is corrected to a voltage V1' to execute overdrive in frame 3. The difference value between the voltages V1' and V1 is a correction value corresponding to the voltage V1 before transition and the voltage V0 after transition.

Further, frame 4 is different from immediately preceding frame 3'. Thus, the voltage V2 is corrected to execute overdrive at a voltage V2' in frame 4. The difference value between the voltages V2' and V2 is a correction value corresponding to the voltage V2 before transition and the voltage V1 after transition. In frames 4' and subsequent frames in FIG. 5, data is kept unchanged from data of the immediately preceding frame 4, so no overdrive is done.

In FIG. 6, overdrive is executed in frame 3 in which the input signal changes from black to halftone 1, and frame 4 in which the input signal changes from halftone 1 to halftone 2. The overdrive amount (correction amount) is different between frames 3 and 4 because the level is different before and after transition.

As a response speed correction method, the correction amount may be changed in accordance with the input level of image data of an immediately preceding frame and that of currently displayed image data on the basis of the LUT. Alternatively, the correction amount may be determined in accordance with the difference between image data of an immediately preceding frame and currently displayed image data. According to the method using the LUT, overdrive optimum for the change level is possible by increasing the correction amount at halftone at which the response speed is low.

The polarity inverter 106 inverts the polarity of the signal and outputs the signal every frame after the speed is doubled.

Figure 7:
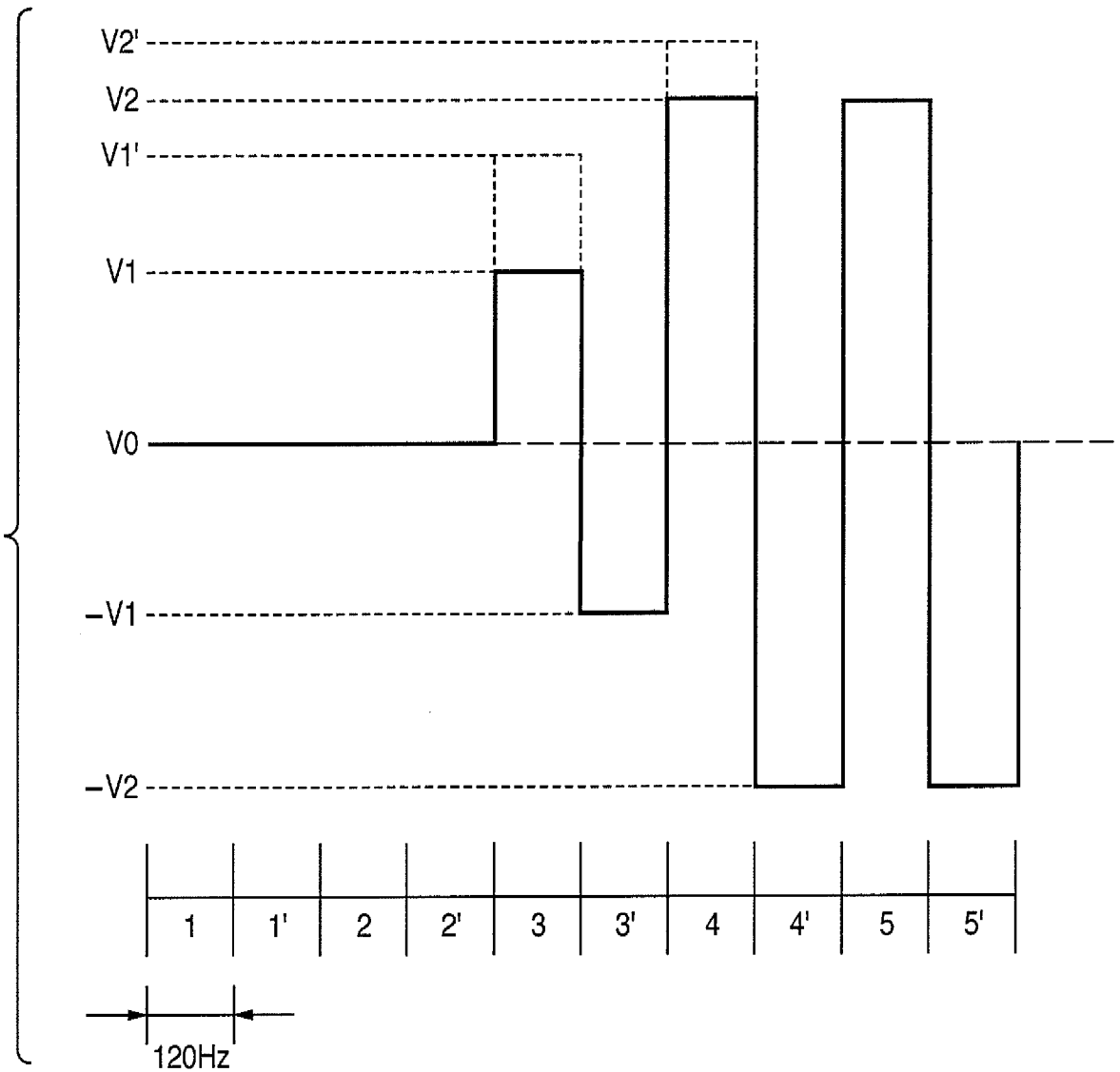
FIG. 7 is a chart showing an example of image data output from a polarity inverter 106 according to the first embodiment of the present invention.

FIG. 7 is a chart showing a state in which the polarity inverter 106 according to the first embodiment inverts the drive polarity of the speed-doubled signal shown in FIG. 6 every frame. Each frame in FIG. 7 is identical to that shown in FIG. 6, and the driving voltages V1, V2, V1', and V2' are also the same as those in FIG. 6.

In FIG. 7, the polarities of adjacent frames out of speed-doubled frames are repetitively inverted such that the first frame has a positive polarity and the next frame has a negative polarity. More specifically, frames 1, 2, 3, 4, and 5 have the positive polarity, and frames 1', 2', 3', 4', and 5' have the negative polarity. If overdrive is executed in the first field after doubling the speed, it is localized to the positive polarity, and a DC component remains in the liquid crystal. To prevent this, the polarity inversion order is altered at a predetermined timing. More specifically, the first field of one input frame after doubling the speed is set to start from the negative polarity.

Figure 8:
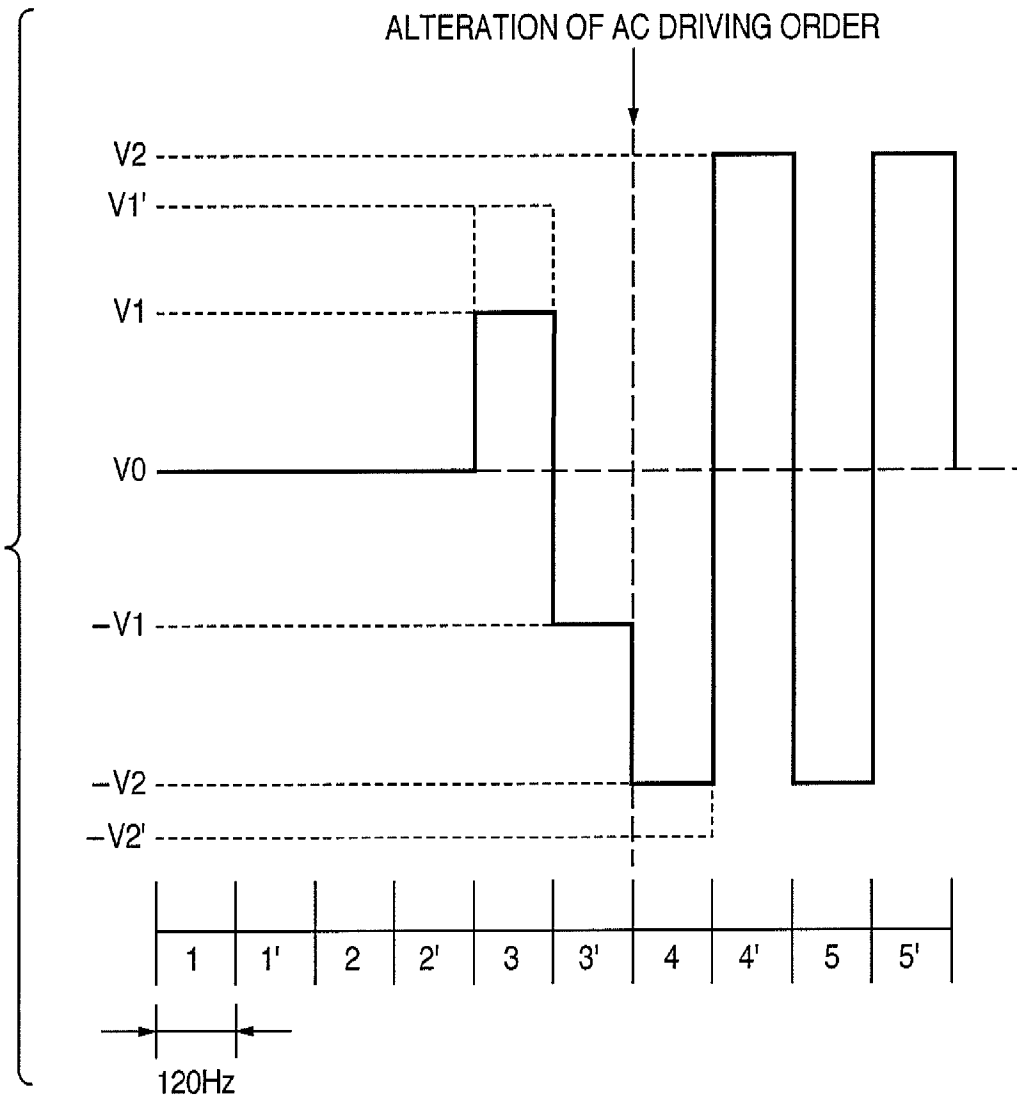
FIG. 8 is a chart for explaining a case where the polarity inversion order of a signal is altered according to the first embodiment of the present invention.

An example of altering the polarity inversion order will be explained with reference to FIG. 8. In FIG. 7, the first fields 1, 2, and 3 after doubling the speed are driven with the positive polarity, and the second fields 1', 2', and 3' after doubling the speed are driven with the negative polarity. If alteration of the AC driving order is designated in switching between frames 3' and 4, the polarity is inverted to drive the first fields 4 and 5 after doubling the speed with the negative polarity, and the second fields 4' and 5' after doubling the speed with the positive polarity. Since the polarity with which overdrive is done is switched, a remaining DC component can be reduced.

Figure 9:
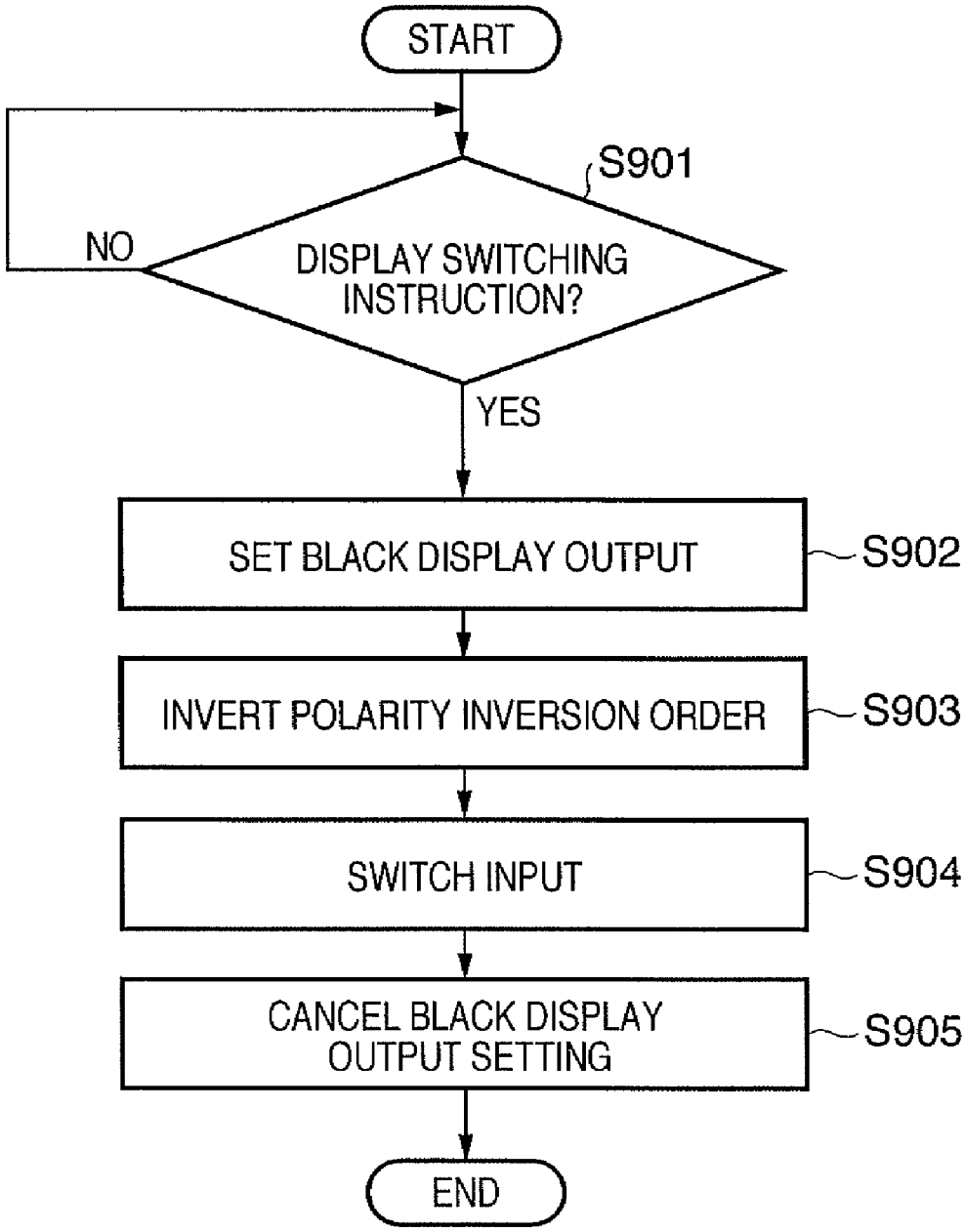
FIG. 9 is a flowchart showing an example of polarity inversion order alteration processing according to the first embodiment of the present invention.

In the first embodiment, the user operates the remote controller 61 to switch an input signal to the display apparatus 200. The polarity inversion order is altered at the timing when the input signal is switched. Polarity inversion order alteration processing will be explained with reference to FIG. 9. FIG. 9 is a flowchart showing an example of polarity inversion order alteration processing.

When the user operates the remote controller 61 to input an input switching instruction, the control panel 62 receives a signal transmitted from the remote controller 61 in accordance with the operation in step S901. The control panel 62 notifies the CPU 63 of the reception of the signal from the remote controller. In response to this notification, the CPU 63 controls the DSP 32 to change the display screen to a black display in step S902. By changing the display screen to a black display, switching noise by the switch 30 when inputting the input switching instruction can be hidden.

While the black display is output, the CPU 63 controls the polarity inversion controller 131 to output a polarity inversion order alteration instruction to the polarity inverter 106 and alter the polarity inversion order in step S903. In step S904, the CPU 63 designates switching of the switch 30 to switch the input to the PC input 50 or NTSC input 51. In step S905, the CPU 63 cancels the black display setting by the DSP 32.

In this manner, the polarity inversion order is altered when the black display is output in input switching. This can suppress degradation of the image quality caused by the flicker of the display screen that occurs when the same polarity continues in altering the polarity inversion order.

In FIG. 9, the polarity inversion order is altered in accordance with the operation of an input signal switching instruction from the remote controller 61. However, the trigger of the alteration is not limited to the operation of an input signal switching instruction. For example, when the user performs an operation for a broadcast program switching instruction (channel switching instruction), the polarity inversion order can also be altered in accordance with the operation.

Figure 10:
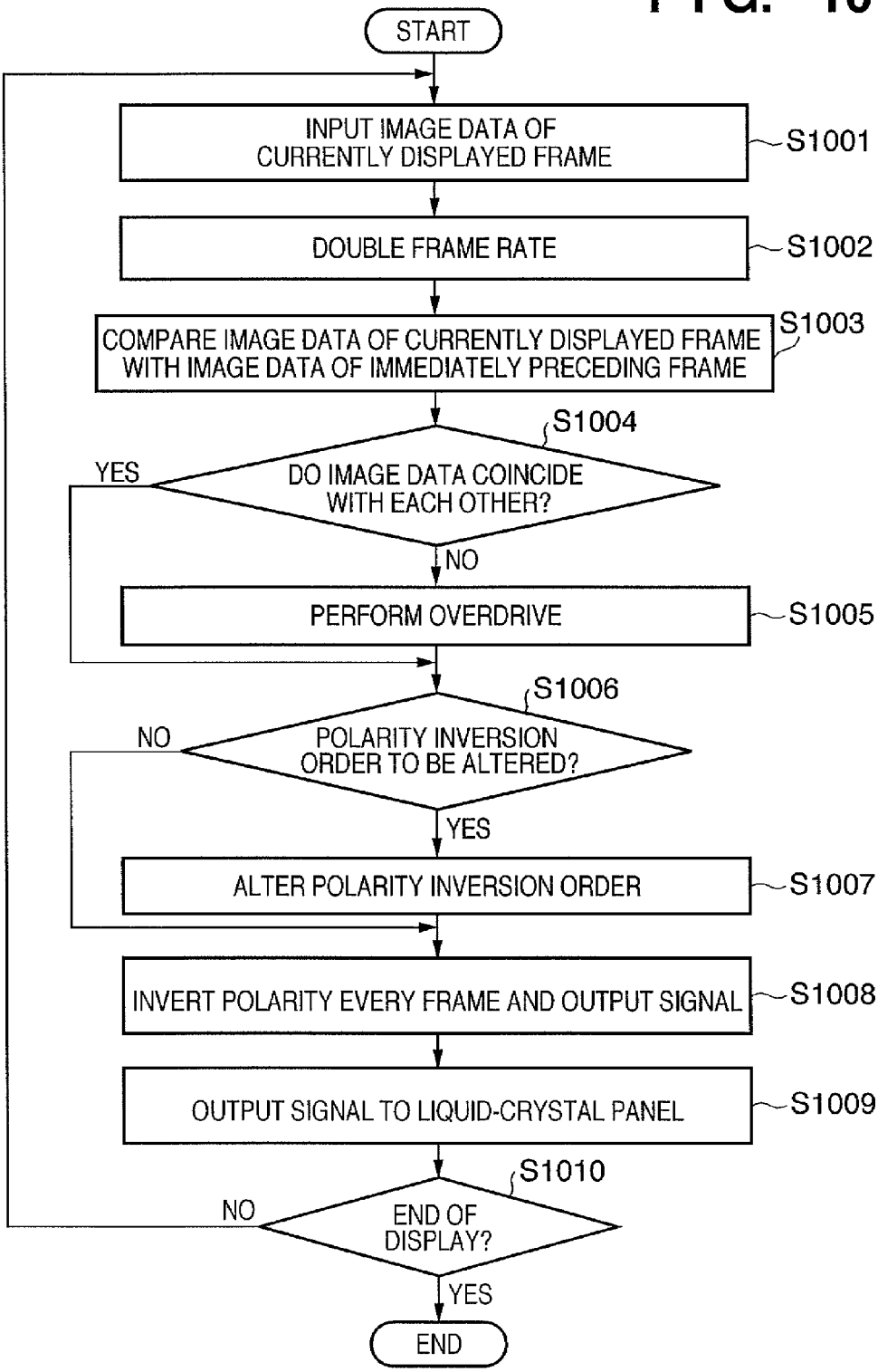
FIG. 10 is a flowchart showing an example of response speed correction processing according to the first embodiment of the present invention.

Response speed correction processing according to the first embodiment will be described with reference to FIG. 10. FIG. 10 is a flowchart showing an example of response speed correction processing according to the first embodiment of the present invention. This processing is executed by the response speed correction unit 103, frame rate converter 101, and polarity inverter 106, but may also be executed under the control of the CPU 63 on the basis of a program stored in the ROM 64.

In step S1001, the frame rate converter 101 receives current image data processed by the DSP 32. In step S1002, the frame rate converter 101 doubles the frame rate of the input current image data. In step S1003, the current image data whose frame rate has been doubled is compared with image data of an immediately preceding frame stored in the memory 33.

If the two image data coincide with each other ("YES" in step S1004), the process shifts to step S1006. If the two image data are different from each other ("NO" in step S1004), the process shifts to step S1005. In step S1005, the response speed correction unit 103 increases or decreases the driving voltage of the current image data in accordance with the transition direction from the image of an immediately preceding frame to that of the current image in order to perform overdrive. More specifically, if the transition direction from the image of an immediately preceding frame to that of the current image is an up direction, the response speed correction unit 103 further increases the driving voltage. To the contrary, if the transition direction from the image of an immediately preceding frame to that of the current image is a down direction, the response speed correction unit 103 further decreases the driving voltage. In step S1006, it is determined whether to alter the polarity inversion order. This determination is based on whether the timing detector 132 has detected the timing to alter the polarity inversion order and the polarity inversion controller 131 designates alteration of the polarity inversion order. If it is determined to alter the polarity inversion order ("YES" in step S1006), the process shifts to step S1007. If it is determined that the polarity inversion order need not be altered ("NO" in step S1006), the process shifts to step S1008.

In step S1007, the polarity inversion controller 131 sets alteration of the polarity inversion order, and the process shifts to step S1008. In step S1008, the polarity inverter 106 inverts the polarity of the signal every frame, and outputs the resultant signal to the D/A converter 35. In step S1009, the R, G, and B liquid-crystal panels 2R, 2G, and 2B are driven for display on the basis of a signal output from the D/A converter 35. In step S1010, it is determined whether to end the image display processing. If it is determined not to end the image display processing ("NO" in step S1010), the process returns to step S1001 to continue the process. If it is determined to end the display processing ("YES" in step S1010), the process ends.

As a result, overdrive is executed uniformly in forward driving and backward driving.

As described above, the first embodiment can balance overdrive voltages in forward driving and backward driving, and improve the reliability of a display image.

Second Embodiment

The second embodiment of the present invention will be explained. The second embodiment will describe a method of altering the polarity inversion order more frequently than in the first embodiment.

Figure 11:
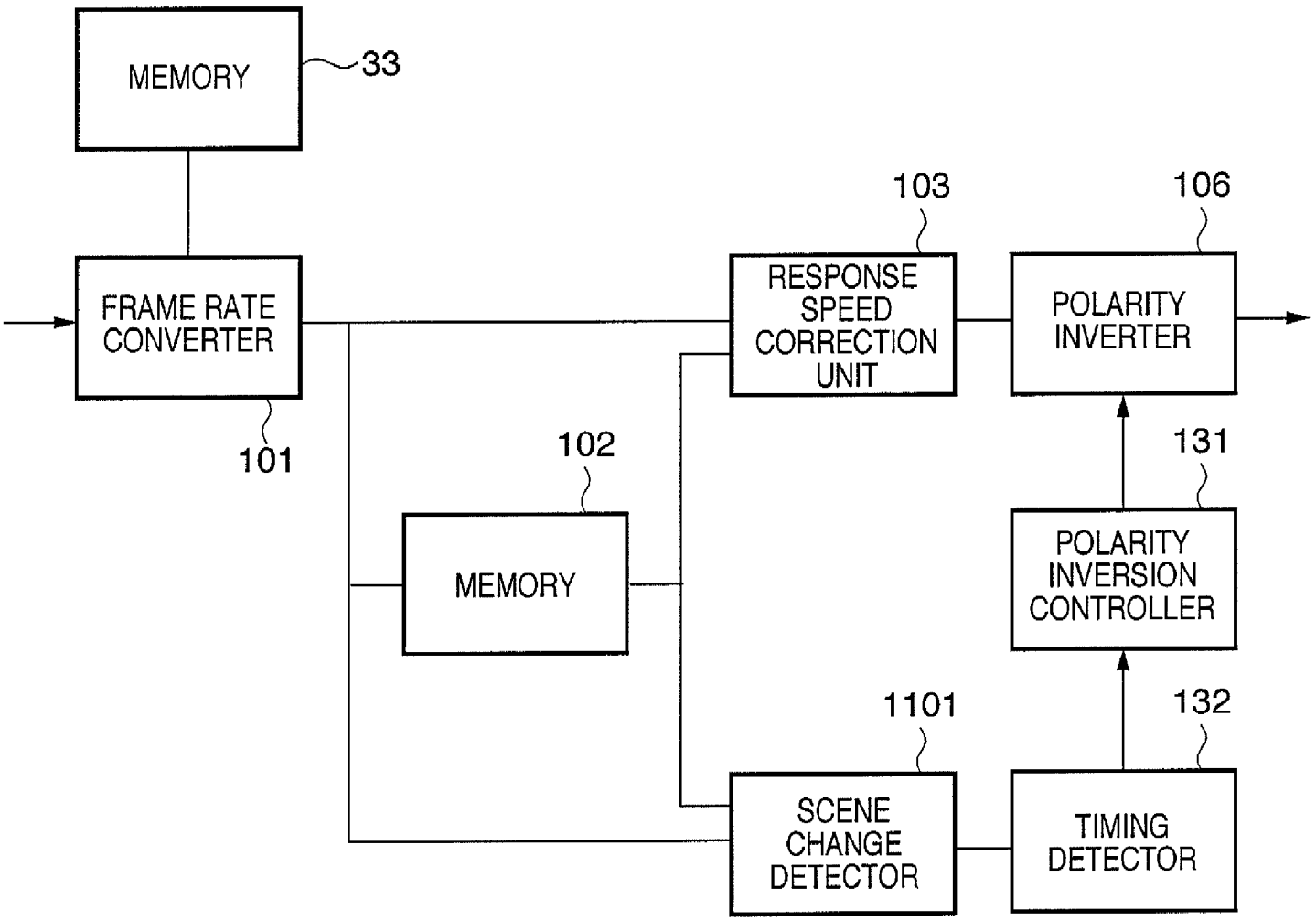
FIG. 11 is a block diagram showing an arrangement of a signal processing system according to the second embodiment of the present invention.

FIG. 11 is a block diagram showing an arrangement of a signal processing system according to the second embodiment. A feature of the arrangement in FIG. 11 is that a scene change detector 1101 is newly arranged on the output side of a frame rate converter 101 in FIG. 3.

The scene change detector 1101 determines whether a scene change has occurred, by comparing the average luminance value of the image of an (immediately) preceding frame output from a memory 102 with that of the image of the current frame output from the frame rate converter 101. In the second embodiment, whether a scene change has occurred is determined on the basis of the degree of change of the average luminance value, e.g., whether the average luminance value has changed by 50%.

If the scene change detector 1101 detects that a scene change has occurred, it notifies a timing detector 132 of the generation of the scene change. In response to this notification, the timing detector 132 notifies a polarity inversion controller 131 that the timing to invert the polarity has come. In response to this notification, the polarity inversion controller 131 sets the polarity inversion order. A polarity inverter 106 alters the polarity inversion order in accordance with the setting, and drives the liquid-crystal panel.

When the polarity inversion order is altered, the flicker may degrade the image quality. However, the degradation of the image quality can be prevented by altering the order when the luminance of the screen greatly changes, e.g., when a scene changes.

In the second embodiment, whether a scene change has occurred is determined from the average luminance. However, the present invention is not limited to this, and the maximum or minimum value of the luminance, color information, or scene information embedded in advance in an image is also available.

In this fashion, the second embodiment can more frequently alter the polarity inversion order using generation of a scene change as a trigger. The second embodiment can balance overdrive voltages in forward driving and backward driving, and further improve the reliability.

Third Embodiment

The third embodiment of the present invention will be explained. The third embodiment will describe an application of the above-described polarity inversion order alteration to a projection display apparatus having a stop mechanism of controlling the light amount to be projected.

Figure 12:
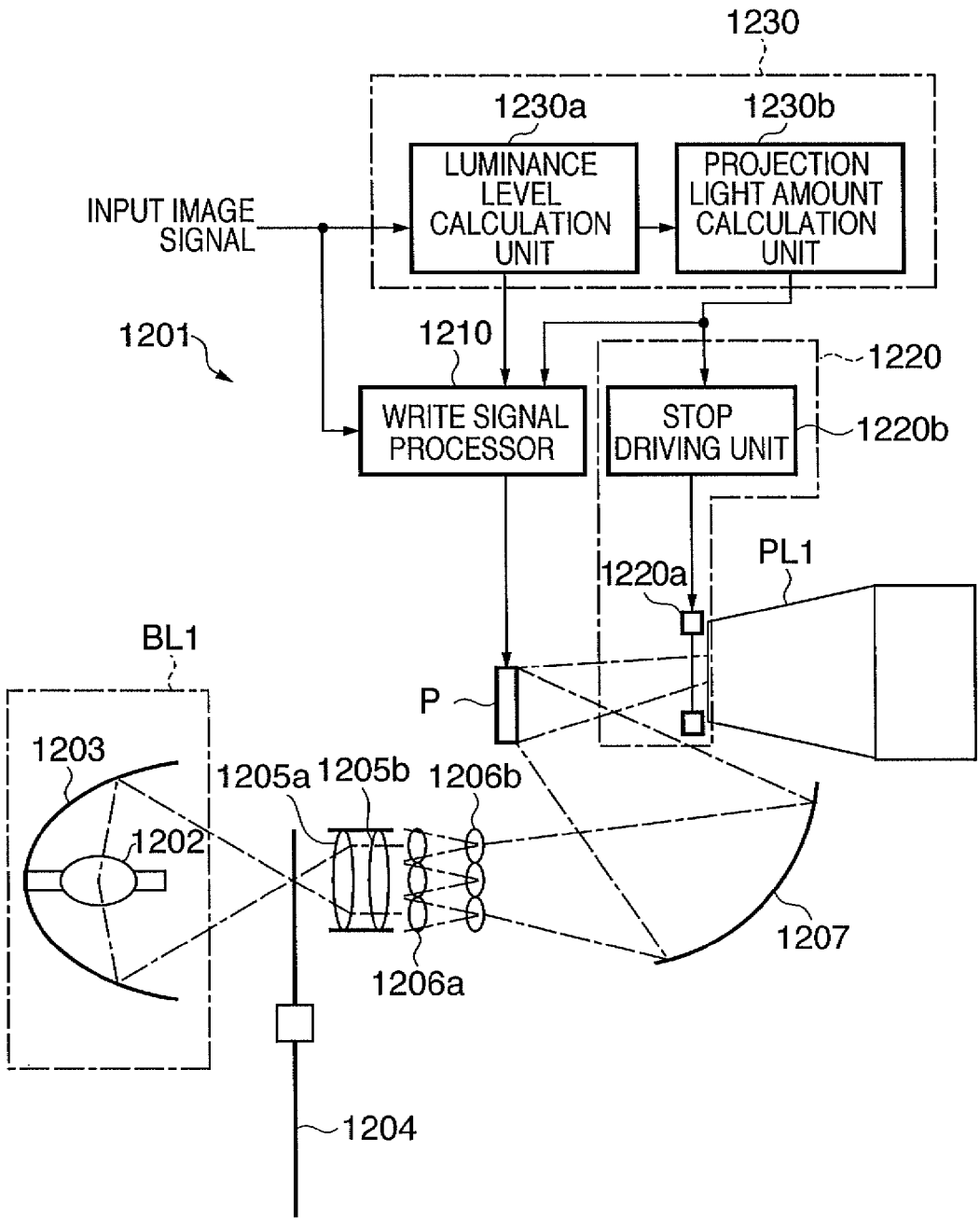
FIG. 12 is a view showing an arrangement of a projection image display apparatus according to the third embodiment of the present invention.
Figure 13:
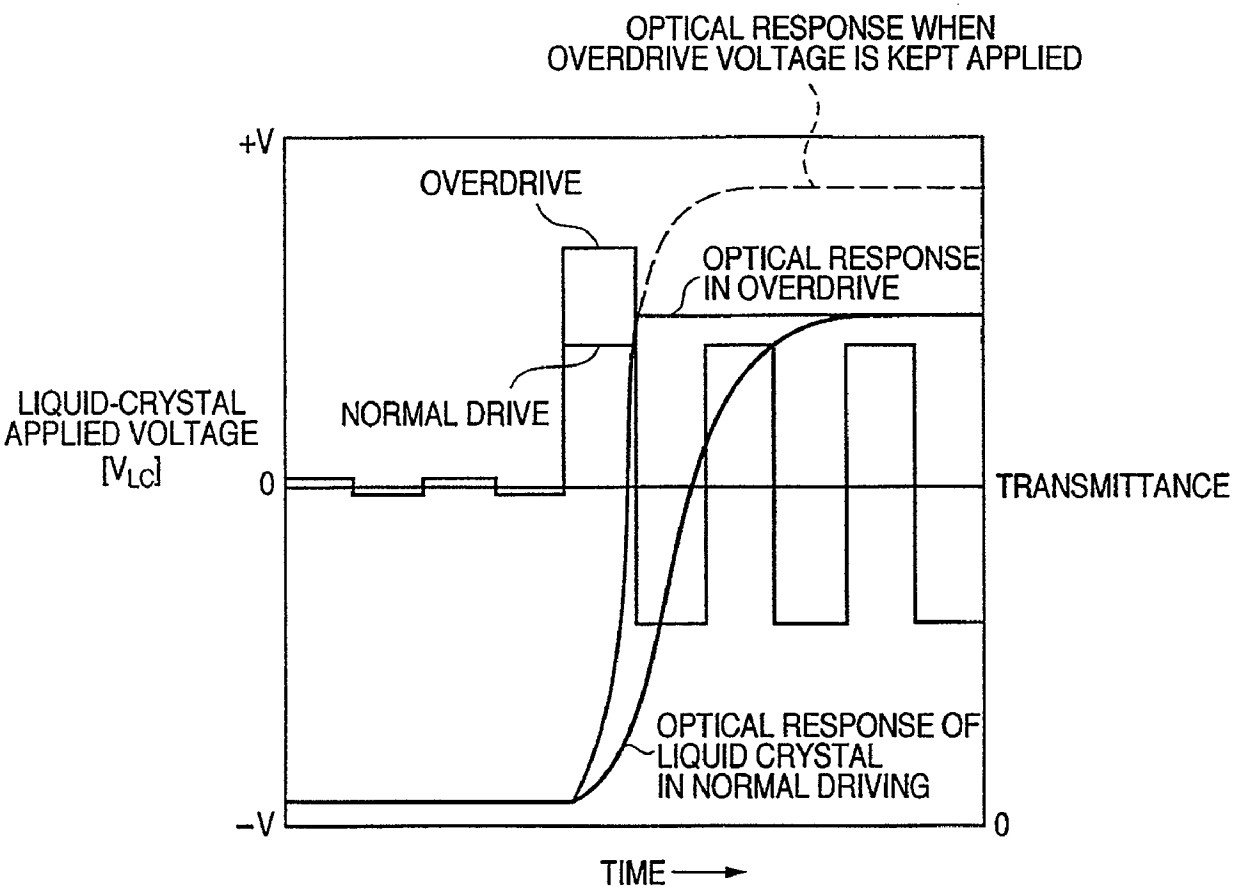
FIG. 13 PRIOR ART
FIG. 13 is a graph for explaining a conventional correction method.

The third embodiment will be explained in detail with reference to the accompanying drawings. FIG. 12 is a view showing an arrangement of a projection image display apparatus according to the third embodiment. In FIG. 12, reference numeral 1201 denotes an overall projection image display apparatus. The projection image display apparatus 1201 comprises a light modulation device P, illumination unit BL1, and projection optical system PL1. The projection image display apparatus 1201 displays an image by projecting light to a screen (not shown).

The light modulation device P displays a halftone image by controlling the light transmission or reflection state. The projection optical system PL1 projects transmitted or reflected light of light entering the light modulation device P. The illumination unit BL1 emits light to the light modulation device P, and includes a reflector 1203 and arc tube 1202. A color filter 1204, telecentric lenses 1205*a* and 1205*b*, and fly-eye integrators 1206*a* and 1206*b* are interposed between the illumination unit BL1 and the light modulation device P. Light integrated by the fly-eye integrators 1206*a* and 1206*b* is condensed to the light modulation device P via a collecting/reflecting mirror 1207.

The projection image display apparatus 1201 further comprises a write signal processor 1210, projection light amount controller 1220, and control signal generator 1230. The write signal processor 1210 modulates a write signal to the light modulation device P. The projection light amount controller 1220 controls the amount of light having passed through or reflected by the light modulation device P. The control signal generator 1230 controls the write signal processor 1210 and projection light amount controller 1220.

When the luminance level is high (i.e., as the luminance level is higher), the control signal generator 1230 generates a control signal on the basis of the luminance level of an input image signal so as to increase the projection light amount and less modulate the write signal. When the luminance level is low (i.e., as the luminance level is lower), the control signal generator 1230 generates a control signal so as to decrease the projection light amount and greatly modulate the write signal.

In the third embodiment, the projection optical system PL1 is preferably formed from so-called schlieren optics. The projection light amount controller 1220 includes a movable stop 1220*a* and stop driving unit 1220*b*, and is arranged not to be conjugate to the light modulation device P. The projection light amount controller 1220 controls the stop value by opening or closing the movable stop 1220*a* by the stop driving unit 1220*b* in accordance with the luminance level of an input image signal.

The control signal generator 1230 comprises a luminance level calculation unit 1230*a* which calculates the luminance level of an input image signal, and a projection light amount calculation unit 1230*b* which calculates the amount of light projected from the projection optical system in accordance with the calculated luminance level. The control signal generator 1230 generates a control signal for the projection light amount controller 1220 on the basis of the projection light amount calculated by the projection light amount calculation unit 1230*b*. Also, the control signal generator 1230 generates a control signal for the write signal processor 1210 on the basis of the luminance level calculated by the luminance level calculation unit 1230*a* and the calculated projection light amount.

The luminance level calculation unit 1230*a* calculates, as a maximum luminance, the maximum value of the luminance signal of each pixel in each field or frame of an input image signal. In this case, the maximum luminance can be calculated by sequentially comparing input image signals within one field or frame. It is desirable to calculate the cumulative histogram of luminance signals of each pixel, and calculate, as a maximum luminance, a luminance level at which the cumulative histogram reaches a predetermined level or more.

When the luminance level calculation unit 1230*a* sets the maximum or average luminance to be equal to or lower than a predetermined level, the movable stop 1220*a* is narrowed down to reduce the projection light amount, providing a sharp black display with less backlight bleeding. At this time, the polarity inversion order of the signal can be altered without degrading the display quality by the flicker.

Even when the control amount of the movable stop 1220*a* is large and the light amount greatly changes, degradation of the image quality by the flicker upon alteration of the polarity inversion order can be prevented. Hence, this timing is preferable for inverting the polarity. In this case, the threshold of the control amount is set. When the control amount exceeds the threshold as a result of comparison with the threshold, the timing to alter the polarity inversion order can be determined.

The third embodiment has described the method of controlling, by the movable stop serving as a light amount modulator, the amount of light reflected by the light modulation device P. However, the present invention is not limited to this, and the light amount modulator may also control the amount of light incident on the light modulation device P. As the light amount modulator, a unit which controls the light amount by using, e.g., deflection of light is also available instead of the stop. However, the present invention is not limited to this.

The light amount modulator is applicable not only to a reflection type element such as an LCOS or DMD, but also to a transmission type liquid-crystal panel.

As described above, the third embodiment can more frequently alter the polarity inversion order using the light amount control status as a trigger. The third embodiment can balance overdrive voltages in forward driving and backward driving, and further improve the reliability.

Fourth Embodiment

The fourth embodiment of the present invention will be explained. In the fourth embodiment, a method of altering the polarity inversion order by a simpler method than the above-described embodiments will be described with reference to FIG. 3.

When supply of operating power starts by turning on a power supply 58 with a power supply SW (not shown), a CPU 63 detects the power ON state, and reads out polarity inversion order information in a previous power OFF state from a nonvolatile RAM 65. A polarity inversion order different from the polarity inversion information read out from the nonvolatile RAM 65 is set in a polarity inversion controller 131. A polarity inverter 106 drives the display panel in a polarity inversion order different from the previous one.

When supply of the operating power stops by turning off the power supply 58 with the power supply SW (not shown), the CPU 63 detects the power OFF state, and writes polarity inversion order information in the power OFF state in the nonvolatile RAM 65.

In this way, the fourth embodiment can more frequently alter the polarity inversion order using the ON/OFF operation of the power switch as a trigger. The fourth embodiment can balance overdrive voltages in forward driving and backward driving, and further improve the reliability.

In the fourth embodiment, the polarity inversion order is altered when the power supply is turned on. However, the present invention is not limited to this, and the polarity inversion order may also be altered when the power supply is turned off.

Fifth Embodiment

The fifth embodiment of the present invention will be explained. In the fifth embodiment, a method of altering the polarity inversion order by a simpler method than the above-described embodiments will be described with reference to FIG. 3.

By using the timer function of a CPU 63, a polarity inversion controller 131 alters the polarity inversion order every time a predetermined time has elapsed. The alteration time preferably falls within the range of about 10 min to 60 min in terms of liquid-crystal characteristics.

By a combination of the timer function and the above-described embodiments, various conditions may also be detected when the arrival of a predetermined time is detected. That is, when the input or channel is switched or a scene change occurs after a predetermined time comes, the polarity inversion order can be altered. In this case, the polarity inversion order can be altered periodically, and degradation of the image quality upon alteration can be prevented.

As has been described above, according to the first to fifth embodiments, the order of forward driving and backward driving is altered at predetermined timings in a liquid-crystal display apparatus which performs AC voltage driving. This can suppress degradation of a signal caused by a DC component upon overdrive. Especially, the arrangement of the embodiments is applicable to a general display apparatus without employing a special structure. The embodiments can provide a high-quality display apparatus without decreasing the reliability.

Other Embodiments

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or script data supplied to an operating system.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM, DVD-R or DVD-RW).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-325925, filed Dec. 1, 2006, which is hereby incorporated by reference herein in its entirety.

What is claimed is:

1. A liquid-crystal display apparatus comprising:

a liquid-crystal display device driven by an AC voltage;

an image divider configured to temporally divide input image data into N (N≧2) for each frame;

a correction unit configured to correct a driving voltage for driving said liquid-crystal display device based on a difference between adjacent divided image data obtained by the N division;

a polarity inverter configured to invert a polarity to make drive polarities of adjacent divided image data different, out of the divided image data obtained by the N division including the divided image data for which driving voltage is corrected by said correction unit;

a driver configured to drive said liquid-crystal display device using the polarity-inverted divided image data;

an inversion order alteration unit which alters an inversion order for the drive polarities;

at least two input units configured to input the image data;

an input switch configured to switch between said at least two input units to input the image data from either input unit; and an input switching acceptance unit configured to accept a switching instruction to said input switch, wherein when image data of a plurality of programs broadcasted using a plurality of channels is input from either of said at least two input units, said input switching acceptance unit further accepts a broadcast program switching instruction, and wherein when said input switching acceptance unit accepts the broadcast program switching instruction, said inversion order alteration unit alters the inversion order.

2. The apparatus according to claim 1, wherein when said inversion order alteration unit alters the inversion order, said driver drives said liquid-crystal display device to output a black display.

3. A computer program which is stored in a non-transitory computer-readable storage medium and causes a computer to function as a liquid-crystal display apparatus having units defined in claim 1.

4. A control method of a liquid-crystal display apparatus, comprising:

temporally dividing input image data into N (N≧2) for each frame;

correcting a driving voltage for driving a liquid-crystal display device based on a difference between adjacent divided image data obtained by the N division;

inverting a polarity to make drive polarities of adjacent divided image data different, out of the divided image data obtained by the N division including the divided image data for which the driving voltage is corrected;

driving the liquid-crystal display device using the polarity-inverted divided image data;

altering an inversion order for the drive polarities;

inputting the image data from at least two input units configured to input the image data;

switching between said at least two input units to input the image data from either input unit; and accepting a switching instruction from said switching step, wherein when image data of a plurality of programs broadcasted using a plurality of channels is input from either of said at least two input units, said input switching acceptance step further accepts a broadcast program switching instruction, and wherein when said input switching acceptance step accepts the broadcast program switching instruction, said inversion order alteration step alters the inversion order.

5. The method according to claim 4, wherein when the inversion order is altered, the liquid-crystal display device is driven to output a black display.

* * * * *